United States Patent [19]

Shimizu

[11] 4,206,948

[45] Jun. 10, 1980

[54] PROCESS FOR SCRUB BRUSH MANUFACTURE

[76] Inventor: Shozaburo Shimizu, 1 2-chome, Kakomachi, Nakamura-ku, Naroya-shi Aichi-ken, Japan

[21] Appl. No.: 5,894

[22] Filed: Jan. 23, 1979

Related U.S. Application Data

[62] Division of Ser. No. 867,723, Jan. 9, 1978, abandoned.

[30] Foreign Application Priority Data

Feb. 4, 1977 [JP] Japan ..... 52-11821

[51] Int. Cl.[2] ..... A46D 3/00; A46D 9/00

[52] U.S. Cl. ..... 300/21; 15/223; 300/2

[58] Field of Search ..... 300/1, 2, 12, 15, 16, 300/17, 21; 15/223, 225, 228; 29/411, 412, 415; 264/230

[56] References Cited

U.S. PATENT DOCUMENTS

| | | | |
|---|---|---|---|
| 2,104,196 | 1/1938 | Harmon | 300/21 |
| 2,310,186 | 2/1943 | Abrams | 300/21 |
| 2,495,559 | 1/1950 | Weiler | 300/21 |
| 2,813,286 | 11/1957 | Strader | 15/225 |
| 3,115,658 | 12/1963 | Moss | 300/21 |

*Primary Examiner*—Howard N. Goldberg
*Attorney, Agent, or Firm*—William Anthony Drucker

[57] ABSTRACT

A scrubbing-brush is manufactured by the following process. First, a number of nets formed of fibers connected with one another are secured. The bundle is bundled at an intermediate portion thereof by a bundling member. Then, the bundle is cut at opposite sides of the bundling member. The thus cut bundle is then heated to cause memory deformation of the fibers, thus completing a scrubbing-brush. The thus finished scrubbing-brush has a number of fibers having respective ends formed with smooth convex bristle surfaces.

4 Claims, 17 Drawing Figures

PROCESS FOR SCRUB BRUSH MANUFACTURE

This is a division of Ser. No. 867,723 filed Jan. 9, 1978, now abandoned.

BACKGROUND OF THE INVENTION

1. Field of the Invention

This invention relates to a scrubbing-brush and process for the manufacture of the scrubbing-brush adapted to be used to remove stains from flatwares or other articles.

2. Description of the Prior Art

In the past, brushes constructed in accordance with the following procedure have been extensively used. That is, a number of holes are made in a base plate formed of wood or plastic material, and a number of hairs or bristles are planted in the holes and secured by use of adhesives or by a mechanical procedure to form a brush.

Since the brush constructed in a manner as described tends to cause the bristles to fallout when the former is scrubbed hard against the surface of an article from which stain is to be removed, these brushes are effectively used only in fields, which require less force, for example, in the case of brushing off dust from clothes or in the case of wiping off stains slightly adhered to flatwares.

Further, in the process for the manufacture as described above, the bristles must be planted in the small holes, and as a consequence, fine work needs be accomplished, and in addition, such a fine work must be applied to a number of holes, resulting in a requirement of much time.

SUMMARY OF THE INVENTION

It is therefore an object of the present invention to provide a scrubbing-brush with which only a part of the fibers in the scrubbing-brush can come out even when the latter is used by being scrubbed against the surface of an article to be washed so as to always keep the bristle foremost surfaces of the number of fibers in smooth and beautiful condition, and which can enhance a scrubbing effect of the scrubbing-brush by maintenance of such smoothness.

It is another object of the invention to provide a scrubbing-brush which can be used for a long period and with a number of fibers orderly arranged without occurrence of partial falling out of the fibers even when the brush is used for a long period in a under conditions as described above.

In addition, it is an object of the manufacturing process in accordance with the present invention to provide an arrangement in which a surface comprising bristle-foremost ends of a number of fibers in a finished scrubbing-brush may be formed into a smooth curved surface merely by simple cutting using a flat cutter when a number of fibers are arranged and cut in the bundled state.

It is another object of the manufacturing process in accordance with the present invention to provide an arrangement in which even though a number of fibers as describd above are bundled, the fibers may be bundled only at an intermediate portion thereof and its operation may be accomplished in a simple manner.

It is a further object of the manufacturing process in accordance with the present invention to provide an arrangement in which in the case of accomplishment of such bundling, even if the bundling mode is loose, a firmly tightened mode may be achieved after having been formed into a scrubbing-brush, and the operation of tightening may be accomplished very easily.

It is another object of the manufacturing process in accordance with the present invention to provide an arrangement in which in a state where the scrubbing-brush has been finished, a bundling wire used for the bundling is entirely covered with a number of fibers in the scrubbing-brush, and a product can be manufactured which can avoid trouble resulting from erroneous contact of the bundling wire with the article to be washed to give a damage thereto when the finished scrubbing-brush is used.

BRIEF DESCRIPTION OF THE DRAWINGS

In the drawings

Preferred embodiments are illustrated in the accompanying drawings, in which

FIG. 13 being a view showing a plurality of strands and FIG. 14 a view showing a state in which a plurality of strands are bundled.

DESCRIPTION OF THE PREFERRED EMBODIMENTS

Figure 1:
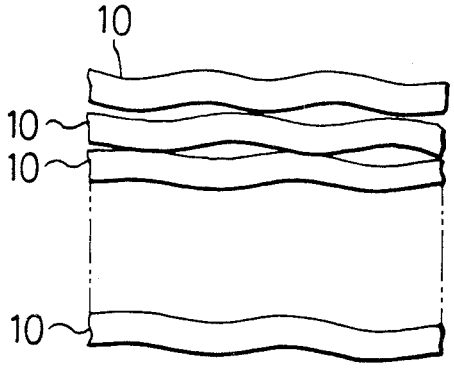
FIG. 1 is a view showing a plurality of netting strands.
Figure 11:
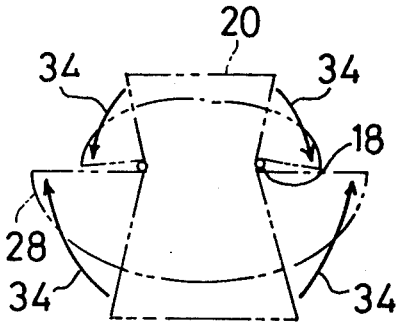
FIG. 11 is a schematic illustration showing change in dimension when a scrubbing-brush element is deformed into the scrubbing-brush.
Figure 12:
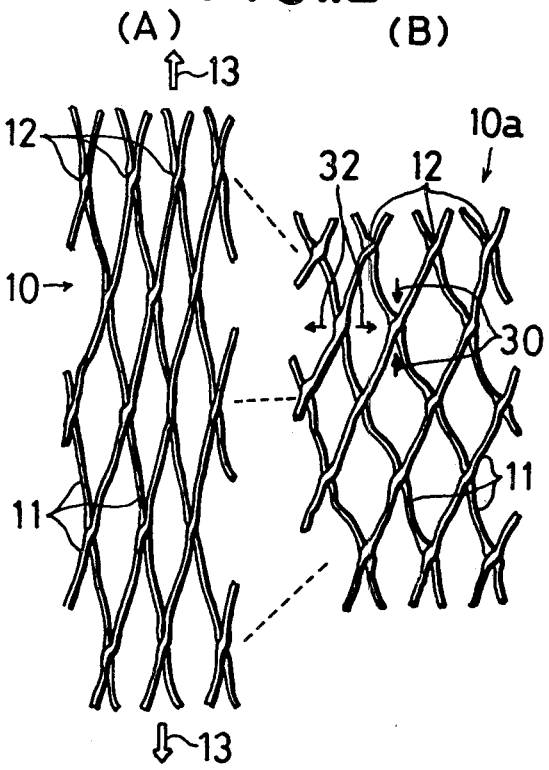
FIG. 12 is a comparison view showing a state of deformation of the elongation netting.

FIGS. 1 through 12 illustrate in detail the process of manufacture for scrubbing-brushes, the manufactured scrubbing-brushes, and elongation nettings used to manufacture the scrubbing-brushes. The process of manufacture for scrubbing-brushes will be hereinafter described in order. First, there are provided with a plurality of elongation nettings 10, 10, . . as shown in FIG. 1. The detailed construction of these elongation nettings 10 is shown in FIG. 12 (A). That is, in FIG. 12 (A), a number of fibers 11, 11, . . are disposed in intersecting relationship with one another, the fibers being integrated with one another at intersections thereof. This netting is obtained by injection molding of thermoplastic resin such as polyethylene and polypropylene in a net-like configuration, introducing the thus molded netting into an elongation tank at a given temperature, and exerting a tension thereon in a direction as indicated at 13 for elongation to form it into a configuration as shown in FIG. 12 (A). Therefore, this netting, in its state thus molded, has a residual stress strain so that when heat is again applied thereto in a free condition, the netting will contract and deform in the lengthwise direction it whereas will expand in the transverse direction, due to the aforesaid residual stress strain. The above-mentioned elongation nettings 10, which are constructed in a manner as described above, include those formed into a long cylindrical configuration in an elongation direction or those formed into a sheet by cutting open the aforesaid cylindrical formation.

Figure 2:
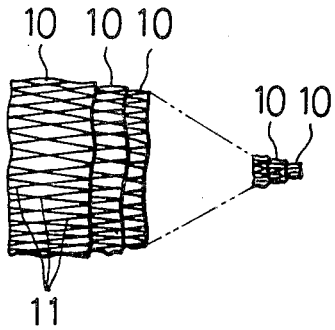
FIG. 2 is a view with a number of nettings axially displaced with one another in order to show the superposed state of the plurality of strands.
Figure 3:
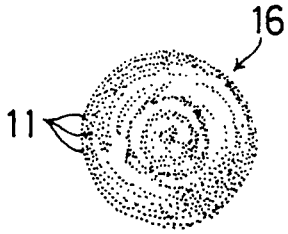
FIG. 3 is a sectional view of a bundle of nettings.

Next, these tubular nettings 10 are placed one within another to form a single multi-layer netting by successively superposing a second cylindrical netting 10 on an external surface of a first cylindrical netting 10, and by superposing a third cylindrical netting 10 on an external surface of the second cylindrical netting 10, as illustrated in FIG. 2. By placing these nettings one above another as described above, a bundle 16 of nettings having a section as shown in FIG. 3 may be formed. While the number of nettings placed one upon another and the diameter of the bundle 16 will be varied depending on the kind and size of bundles to be manufactured, it will be noted as one example that a bundle 16, of which the diameter is 5 cm to 6 cm in a state where 60 to 70 sheets of nettings are placed one upon another and are then slightly tightened, may be formed. In such a bundle 16, a number of nettings 10, 10 are placed one upon another so that the respective nettings are substantially in concentric relationship. Accordingly, where different colors are used for these nettings, these nettings are superposed in the form of an annular ring to provide a colorful external appearance.

Figure 4:
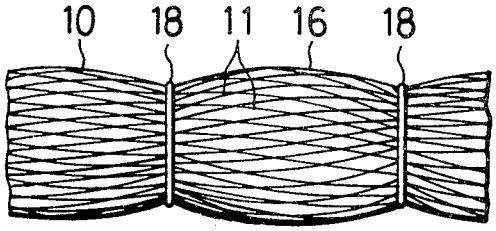
FIG. 4 is a view showing a bundled state.

Next, the bundle may be bundled by bundling members 18 as shown in FIG. 4. This bundling may be effected by bundling the bundle 16 using the bundling members 18 of a given length and intertwisting opposite ends of the bundling members 18. Taking into consideration the intended use of finished scrubbing-brushes, the bundling members 18 are selected so that for example, where the scrubbing-brushes are used in water, bundling members used are those, which are hard to rust, for example, such as a bundling member in which an outer surface of a metal wire is coated with a plastic material or covered with a plastic tube. Further, a ring formed of a plastic material may also be used. This bundling may be made tightly to the extent that the bundling members 18 are not easily moved along the length of the bundle 16, and the strength of bundling may suitably be increased or decreased. Spacings between a number of bundling members 18, 18 may be variously determined depending on the size of the scrubbing-bruses to be manufactured or the length of fibers constituting a scrubbing-brush. As for one example, where the diameter of the bundle 16 is as previously mentioned, the spacing may be set from 6 to 8 cm.

Figure 5:
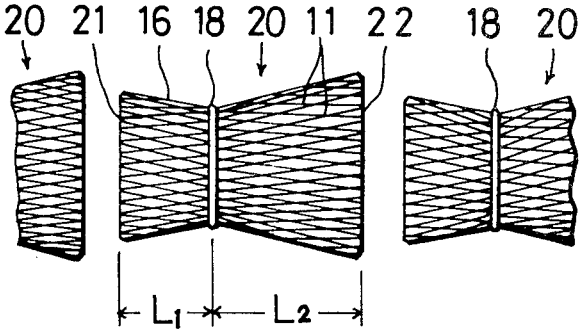
FIG. 5 is a view showing a state with the bundle cut.

Next, the bundle 16 is cut at opposite ends thereof with the bundling member 18 located in an intermediate position between the ends so as to form scrubbing-brush blanks. This cutting may be effected by a known cutter of a flat and simple construction. This cutting is shown in FIG. 5. The decision of positions at which such a cutting is taken place, that is, the decision of distance $L_1$ from the bundling member 18 to an end 21 in the scrubbing-brush blank 20 and of distance $L_2$ from the bundling member 18 to an end 22 will be apparent from the ensuing description. It is also possible to reverse the order of these processes, namely, the process of bundling and the process of cutting.

Figure 6:
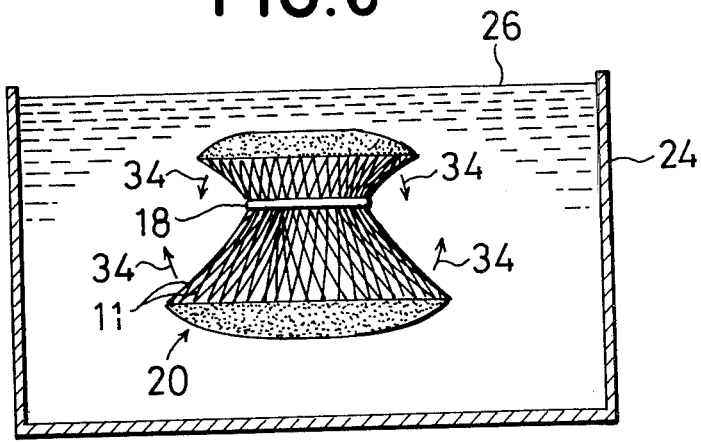
FIG. 6 is a view showing the cut bundles in a hot water bath.
Figure 7:
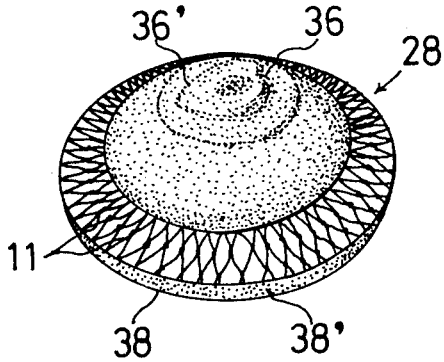
FIG. 7 is a perspective view of a finished scrubbing-brush.
Figure 8:
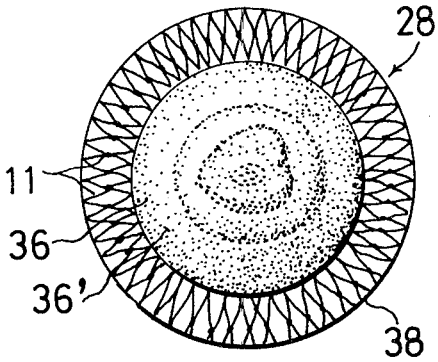
FIG. 8 is a plan view of the scrubbing-brush.
Figure 9:
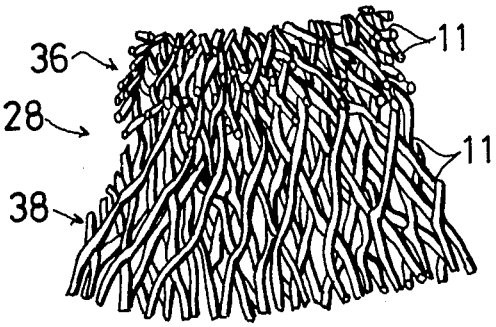
FIG. 9 is a an enlarged view of part of the scrubbing-brush.
Figure 10:
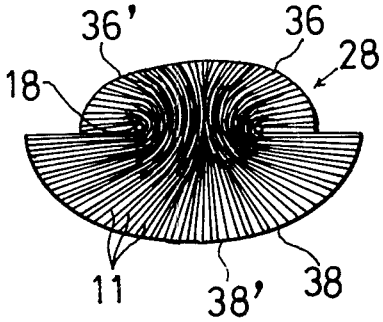
FIG. 10 is a longitudinal sectional view of the scrubbing-brush.

The thus formed scrubbing-brush blank 20 is next subjected to the process of heating. One means of such heating is the hot water means as shown in FIG. 6. That is, the scrubbing-brush blank 20 is immersed in hot water within a hot water tank 24, as shown in FIG. 6. A number of nettings 11 in the scrubbing-brush blank 20 immersed in the hot water bath as described are deformed as shown in FIG. 11 into a scrubbing-brush 28 having a configuration as shown in FIG. 7. Such a deformation occurs for reasons the following. That is, since the elongation netting 10 is formed by strongly elongating a netting composed of a number of fibers as described previously in the direction of arrow 13 as indicated in FIG. 12 (A), when an external stimulus like the heat of the hot water 26 is exerted upon the netting 10, the residual stress strain due to the elongation in the direction as indicated at arrow 13 in the intersections 12 cause the fibers to be returned to their original state, as a consequence of which the fibers 11 as shown in FIG. 12 (B) contract lengthwise and become slightly larger in diameter, whereas the intersections 12 contract in the direction of the arrow 30 and at the same time expand in the direction of the arrow 32, thus returning to a netting 10*a* in a non-elongated state. Accordingly, in the scrubbing-brush blank 20, a number of nettings 10 are placed one above another and a number of intersections 12 are close to one another so that when each intersection 12 is widened in the direction of the arrow 32 as previously mentioned due to the hot water bath, the nettings 10 in the scrubbing-brush blank 20 tend to be widened widthwise as a whole. However, the scrubbing-brush blank 20 is tied at its intermediate portion by the bundling member 18, and hence, it cannot be widened at said portion as a whole. For this reason, the scrubbing-brush blank appears as though widened as a whole at portions other than those bundled by the bundling members 18, and the number of nettings 10 may be widened in the direction of the arrow 34 as shown in FIG. 11 and thus a scrubbing-brush 28 having a configuration as shown in FIGS. 7 to 10 may be formed. In this case, it will be noted that in a portion bundled by means of the bundling member 18, the fibers 11 themselves become greater in diameter and the intersections 12 also become greater in diameter so that even if the bundling member is loosely tied as previously mentioned, the scrubbing-brush blank assumes a state where the former is closely entered inside the annular bundling member 18, that is to say, a state where the bundling member 18 is firmly tied. The temperature of the hot water 26 in the case of the hot water bath as described above is determined depending on the emergence of properties in which the residual stress strain in the netting 10 is to be restored. It is therefore necessary to change temperatures depending on the material used for nettings. In the case of the illustrated embodiment, hot water at a temperature, for example, from 90° to 100° C., is used. It should be noted that the time for the hot water bath is also similarly determined. In the illustrated embodiment, the time selected is for example, from about 15 seconds to about 100 seconds.

Other means employed in this process of heating include a means wherein a scrubbing-brush blank is passed through a known heating tunnel in the periphery of which is disposed a heating source such as a heater, or a means wherein a scrubbing-brush blank is charged into a container, into which high temperature and high pressure vapor or air is blown to heat the scrubbing-brush blank. In this case, the heating temperature may be suitably selected, for example, between 90° C. and 150° C.

The thus formed scrubbing-brush 28 may be bundled by selecting different distances $L_1$ and $L_2$ from the bundled portion to ends 21 and 22, respectively to thereby obtain scrubbing-brush elements 36 and 38 whose bristle-foremost surfaces 36' and 38' are different in size. In the case of the illustrated embodiment, since the aforementioned distances $L_1$ and $L_2$ are 3 cm and 4 cm, respectively, the density of the fibers 11 in the feather-foremost surface 36' of the scrubbing-brush element 36 is greater than that of the bristle-foremost surface 38' in the scrubbing-brush element 38 so that the scrubbing-brush element 36 is harder than the scrubbing-brush element 38. It will be noted that the density of the fibers 11 in the bristle-foremost surfaces of these scrubbing-brush elements may suitably be varied by suitable selection of the diameter of the bundle 16 in the scrubbing-brush blank 20 in relation to the distance from the bundled portion to the end, or the strength of bundling by means of the bundling member 18, or the kind of netting 10. That is, if the length of the fibers is made greater than the diameter of the bundle 16, if the bundling is made less strengthened or if a soft netting is used, a soft scrubbing-brush may be obtained, and in the case conversely thereof, a hard scrubbing-brush may be obtained.

Since the thus formed scrubbing-brush 28 uses nettings with a number of fibers 11 connected with one another, even when an article to be cleaned such as a flatware, from which stain is removed, is scrubbed hard with the scrubbing-brush 28, there is no possibility at all to displace any fiber in position cause it to fall out.

Further, since this scrubbing-brush is provided on one surface thereof with a hard scrubbing-brush element 36 and on the other surface thereof with a soft scrubbing-brush element, the scrubbing-brush can be used both in the case of briskly scrubbing-off stains adhered to the article to be cleaned and in the case of softly wiping-off stains lightly adhered thereto. Moreover, since the scrubbing-brush 28 is heated to sufficiently remove a residual strain from the netting as previously mentioned, there occurs no deformation even if the brush is immersed in hot water during the use thereof.

In addition, when the scrubbing-brush 28 is manufactured by the use of nettings different in color, it assumes an annular ring as described above so that the scrubbing-brush is attractive.

Figure 13:
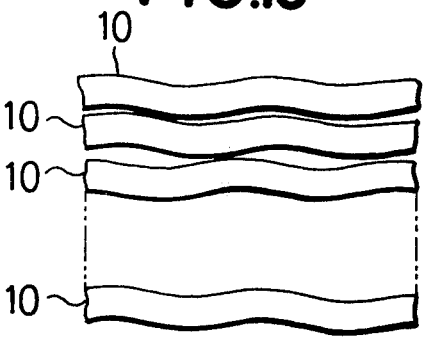
FIG. 13 and FIG. 14 are respectively views showing a modified form of the process of the manufacture.
Figure 14:
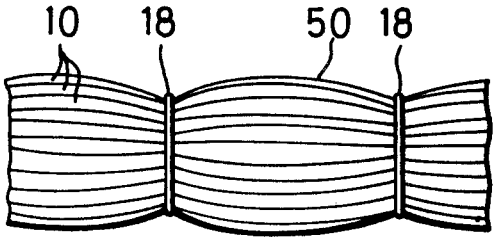

In the following, a description will be given with reference to FIGS. 13 and 14, which illustrate modified forms of means for forming a bundle of nettings in the process of manufacture according to the above-mentioned embodiments. The process will be described hereinafter. First, a number of elongation nettings 10, 10 similar to the previous embodiment are prepared as shown in FIG. 13. Next, these nettings are arranged in parallel as shown in FIG. 14 into a single bundle 50, which is then bundled by the bundling members 18 in a manner similar to the previous embodiment. Thereafter, the processes of cutting and heating may be accomplished in a manner similar to the previous embodiment to thereby form a scrubbing-brush of the shape similar to that as described in the previous embodiment. It will be noted that the thus manufactured scrubbing-brush may be formed into a scrubbing-brush having a spot pattern by mixing a number of nettings of material of different colors.

Figure 15:
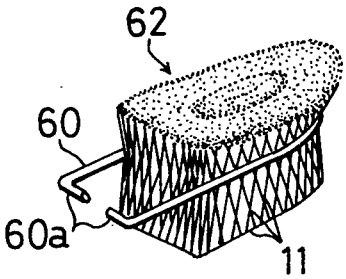
FIGS. 15 through 17 are respectively views showing the process for manufacturing scrubbing-brushes different in configuration.
Figure 16:
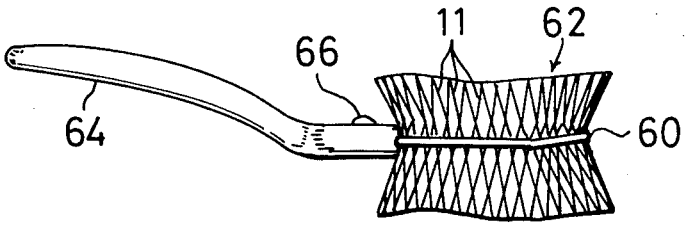
Figure 17:
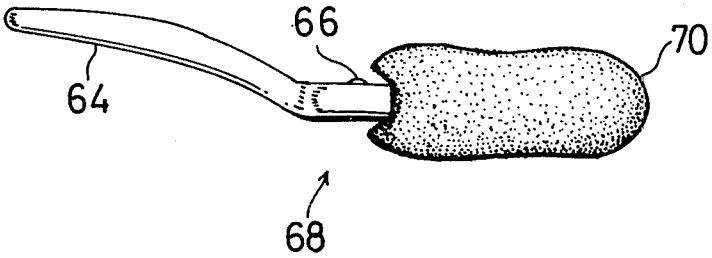

Next, a description will be given with reference to FIGS. 15 to 17, which illustrate the process of manufacturing a scrubbing-brush with a handle in accordance with means similar to the embodiments previously described. A bundling member 60 is slipped on a bundle of elongation nettings made in accordance with means similar to the above-mentioned embodiments, and the bundle is cut in a given dimension to form a scrubbing-brush blank 62 as shown in FIG. 15. This bundling member 60 is manufactured by bending a somewhat large-diameter and rigid wire into an elongated U-shape configuration, free ends **60*a* of which are inwardly bent as shown. Even if the bundle is bundled by the U-shaped bundling member 60, a sectional shape of the bundle may be freely deformed depending on the shape of the bundling member 60 because the bundle comprises nettings of small-diameter fibers arranged as previously mentioned. Then, a handle 64 formed of a suitable material such as plastic, wood, metal and the like as shown in FIG. 16 is attached to the bundling member 60. This attachment of the handle 64 to the bundling member may be accomplished by a procedure, which is well-known, in which both the free ends 60*a* and 60*a* of the bundling member 60 are placed close to each other and then inserted into recesses formed in one end of the handle 64, after which the bundling member may be secured by stop means such as rivet or screw. Other suitable procedures may also be employed. Thereafter, a scrubbing-brush 62 with a handle 64 attached thereto is subjected to heating in a manner similar to the above-mentioned embodiments to form a finished scrubbing-brush 68 having a scrubbing-brush element 70** whose bristle-foremost surfaces of a number of nettings are in the form of a smooth curved surface.

Since the scrubbing-brush 68 with a handle shaped as described above has the elongated scrubbing-brush element 70, it is suitable for washing the internal surface of an article such as a glass of which mouth is narrow and its depth is deep. In this case, since the bundling member 60 is formed of a rigid material as previously described, the scrubbing element 70 is never bent during use.

What is claimed is:

1. A process, for the manufacture of a scrubbing brush, comprising the steps of:

(i) assembling a plurality of elongatable nettings each having a plurality of fibers connected to one another (ii) forming said assembly of nettings into a bundle and securing it in that condition with a bundling member applied at a predetermined position thereon intermediate the ends of the bundle (iii) cutting said bundle at two positions spaced respectively at each side of the position of application of the bundling member (iv) heating said cut bundle to cause the fibers of the nettings to contract lengthwise of the bundle and to expand diametrically of the bundle so as to increase the diameter of the bundle as a whole other than at the position of application of the bundling member, and so as to cause the exposed ends of the cut bundle to assume a circular configuration.

2. The process claimed in claim 1, wherein the heating of the cut bundle is carried out by immersing the cut bundle in a water bath.

3. The process claimed in claim 1 wherein the position of application of the bundling member to the bundle is such that the bundling member is disposed at a different distance from one end of the bundle than from the other end, whereby the exposed ends of the cut bundle assume different characteristics.

4. The process claimed in claim 1 wherein the plurality of elongatable nettings includes more than two nettings having respective different colors, said nettings being bundled such that the exposed ends of the nettings, upon cutting, are annular.

* * * * *